United States Patent [19]

Matkan

[11] 4,021,586

[45] May 3, 1977

[54] METHOD OF AND MEANS FOR THE DEVELOPMENT OF ELECTROSTATIC IMAGES

[75] Inventor: Josef Matkan, Malvern, Australia

[73] Assignee: Canon Kabushiki Kaisha, Tokyo, Japan

[22] Filed: Oct. 17, 1973

[21] Appl. No.: 407,167

Related U.S. Application Data

[63] Continuation of Ser. No. 187,002, Oct. 6, 1971, abandoned.

[30] Foreign Application Priority Data

Oct. 8, 1970 Australia ..... 2791/70

[52] U.S. Cl. ..... 427/17; 427/39; 118/7; 118/661; 355/10; 96/1 LY; 361/228

[51] Int. Cl.[2] ..... G03G 13/10

[58] Field of Search ... 117/37 LE, 93.4 R, 93.4 NC, 117/93.4 A; 118/637, DIG. 23, 7; 355/10, 17; 96/1 R, 1 LY; 317/3; 427/13, 15, 16, 17, 39

[56] References Cited

UNITED STATES PATENTS

| | | | |
|---|---|---|---|
| 2,877,133 | 3/1959 | Mayer | 118/DIG. 23 |
| 2,898,279 | 8/1959 | Metcalfe et al. | 117/37 LE |
| 2,901,374 | 8/1959 | Gundlach | 117/17.5 |
| 2,968,553 | 1/1961 | Gundlach | 117/17.5 |
| 3,084,043 | 8/1963 | Gundlach | 117/37 LE |
| 3,152,012 | 10/1964 | Schaffert | 117/17.5 |
| 3,203,394 | 8/1965 | Hope et al. | 118/637 |
| 3,216,844 | 11/1965 | King | 117/17.5 |
| 3,232,190 | 2/1966 | Willmott | 117/17.5 |
| 3,247,007 | 4/1966 | Oliphant | 117/37 LE |
| 3,247,825 | 4/1966 | Johnson | 118/637 |
| 3,251,706 | 5/1966 | Walkup | 117/17.5 |
| 3,257,223 | 6/1966 | King | 118/637 X |
| 3,284,224 | 11/1966 | Lehmann | 117/17.5 |
| 3,299,806 | 1/1967 | Sawada et al. | 101/114 |
| 3,305,459 | 2/1967 | Smith et al. | 204/18 |
| 3,368,526 | 2/1968 | Matsumoto et al. | 117/37 LE |
| 3,383,209 | 5/1968 | Cassiers et al. | 117/37 LE |
| 3,405,682 | 10/1968 | King et al. | 118/637 |
| 3,592,678 | 7/1971 | Honjo et al. | 118/637 X |
| 3,601,092 | 8/1971 | Satomi | 118/637 |
| 3,669,073 | 6/1972 | Savit et al. | 118/637 |
| 3,699,920 | 10/1972 | VonGrabe | 118/637 |
| 3,722,994 | 3/1973 | Tanaka et al. | 355/10 |

*Primary Examiner*—Ronald H. Smith
*Assistant Examiner*—Stuart D. Frenkel
*Attorney, Agent, or Firm*—Fitzpatrick, Cella, Harper & Scinto

[57] ABSTRACT

A method of and means for developing electrostatic latent images using liquid dispersed toners in which method toner from said liquid suspension is first deposited on the surface of a transport member by electrostatic means and the transport member carrying the deposit of toner material is subsequently brought into contact with the latent image-bearing surface of a recording member to develop the latent image without appreciably wetting the recording member surface, excess developer being carried back to the liquid suspension source by the transport member.

12 Claims, 4 Drawing Figures

METHOD OF AND MEANS FOR THE DEVELOPMENT OF ELECTROSTATIC IMAGES

This is a continuation of application Ser. No. 187,002, filed Oct. 6, 1971 Method and Means for the Development of Electrostatic Images, now abandoned.

This invention refers to a method and means whereby electrostatic latent images contained on a surface may be developed with a liquid dispersed toner material without such surface becoming wetted with toner dispersant to any appreciable extent.

BACKGROUND OF INVENTION

Electrostatic image forming processes are known in which an electrostatic latent image contained on the surface of an electrosensitive member is developed by contacting such surface with an electroscopic powder, such electroscopic powder being either dry or dispersed in an insulating carrier liquid, such carrier liquid or dispersant normally having a volume resitivity greater than $10^9$ ohm-cm and dielectric constant less than 3. These prior art dry and liquid dispersed toning techniques are well known in electrophotographic office copying machines and the like, in which an electrostatic latent image on a photosensitive recording member is developed on such member, and may be retained on such member or transferred to another sheet, such as a paper web or the like as desired.

The prior art processes have certain inherent disadvantages, in that dry development processes are normally incapable of producing high definition copy due to the relatively coarse nature of the dry toner material, and in addition are incapable of half tone reproduction as normally used in the art. Liquid dispersed toners are able to produce images of superior definition with excellent half tone rendition, but suffer the disadvantage that the copy sheet becomes wetted with dispersant liquid, which is normally removed by the application of heat which introduces solvent vapor into the atmosphere.

SUMMARY OF INVENTION

This present invention teaches a method whereby the superior definition and tone rendition features of the liquid dispersed toner may be retained without the necessity for wetting the copy sheet to any great extent, thus allowing the production of substantially dry copy without introducing solvent vapor into the atmosphere. In addition this present invention presents toner material of accurately controlled polarity and density to the surface being developed and thus allows the development of images to extremely uniform density and devoid of background stain.

The present invention uses a liquid dispersed toner material, which material is electrodeposited on to a roller or a belt or other transport means as desired, which transport means carries the toner deposit out of the bath of liquid dispersed toner to a remote position at which the toner deposit is contacted with the surface being developed. The thickness of the toner deposit may be varied by alteration in the strength of the electrodepositing field, thus allowing accurate control of the image density, while the absence of a body of liquid at the image developing location prevents liquid absorption by the surface being developed, which absorption is responsible for in excess of 95% of the liquid carryout of prior art liquid developing systems.

It will be realised that such a developing means, although producing images that are virtually dry, still contains a small quantity of dispersant within the toner deposit on the transport means, and we have found that this liquid content may be still further reduced by the placing of a corona generating wire or roller or the like in a position adjacent to the coated transport means, and applying a corona producing voltage which depresses the liquid contained within or over the toner deposit, returning such liquid to the bulk container. Such corona generator may also if required be adjusted to reinforce the charge on the individual toner particles or change their orientation within the toner deposit.

When the toner bearing transport means contacts the latent image being developed the deposited toner particles are transferred by electrostatic attraction to the latent image, which action leaves a negative or reverse reproduction of the developed image on the surface of the transport means. While it is acceptable to provide a scraper blade or the like to remove such unused toner deposit from the transport means prior to recoating the transport means for further image development we have found it advantageous to formulate the liquid dispersed toner to form a deposit in such a manner that the toner deposit on the transport member acts as a voltage dependent field limiting means, which field limiting characteristic causes the deposition of toner to possess a self-levelling characteristic. Provided such a toner formulation is used it is not necessary to remove excess toner deposit from the transport means after image development as recoating of the transport means only occurs in those areas from which toner has been removed by image development or other removal steps, and thus recoating of the transport means removes irregularities in the deposit caused by a prior development operation, accidental handling or the like and allows a substantially uniform toner deposit to be presented at the developing location, such uniform toner deposit not being influenced by previous developing operations that have taken place at the same position on the transport means.

In this present invention as described so far the toner has been deposited on the transport means using a depositing electrode within the bath of liquid dispersed toner, however, if the surface of the transport means is of sufficiently high electrical resistivity, such as for instance in excess of about $10^{11}$ ohm/sq.cm it is possible to electrostatically charge such surface prior to immersion of the transport means within the toner bath, whereby such charged surface will attract and hold a toner deposit, the thickness of which is dependent on the pre-impressed charge intensity.

STATEMENT OF INVENTION

This invention therefore relates to a method for developing electrostatic latent images using liquid dispersed toners in which method toner from said liquid suspension is first deposited on the surface of a transport member by electrostatic means, and the transport member carrying said deposit of toner material is subsequently brought into contact with the latent image bearing surface of a recording member to develop said latent image without wetting the recording member surface to any substantial extend. The transport member subsequently is returned to the toner suspension and re-coated with toner for development of further latent images.

BRIEF DESCRIPTION OF THE DRAWINGS

The accompanying drawings illustrate preferred embodiments only, and are not included in the limiting or restricting sense, and in these.

DESCRIPTION OF PREFERRED EMBODIMENTS

Figure 1:
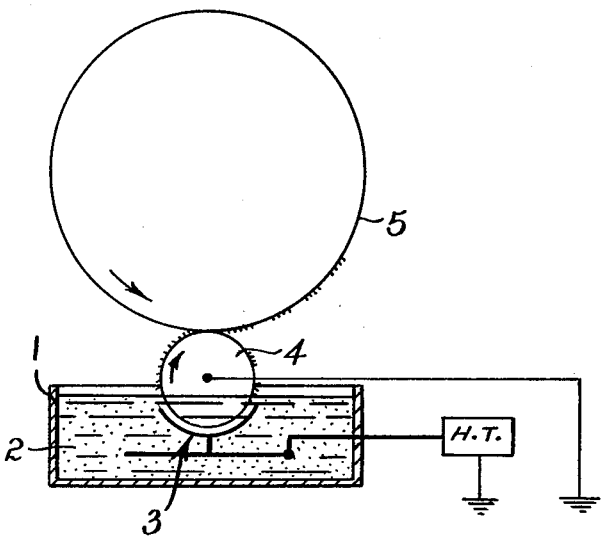
FIG. 1 shows a schematic view of one form of carrying the invention into effect.

Referring to FIG. 1, a tank or bath 1 contains a body of liquid dispersed toner 2. A roller 4 is mounted to rotate with part of its outer surface immersed in the toner suspension 2, and is positioned adjacent to a depositing electrode 3, which electrode is also immersed in the toner suspension. The roller 4 is preferably but not necessarily grounded, whereas the electrode 3 is connected to the output of a high tension power supply, whereby either a positive or a negative high voltage may be applied to electrode 3, as required. Roller 4 becomes covered with a uniform deposit of toner material, and transports such toner material to the surface to be developed 5. As the roller 4 rotates, sections which have contacted the surface being developed 5 become re-immersed in the toner bath and a further deposit of toner is formed by the action of depositing electrode 3.

Figure 2:
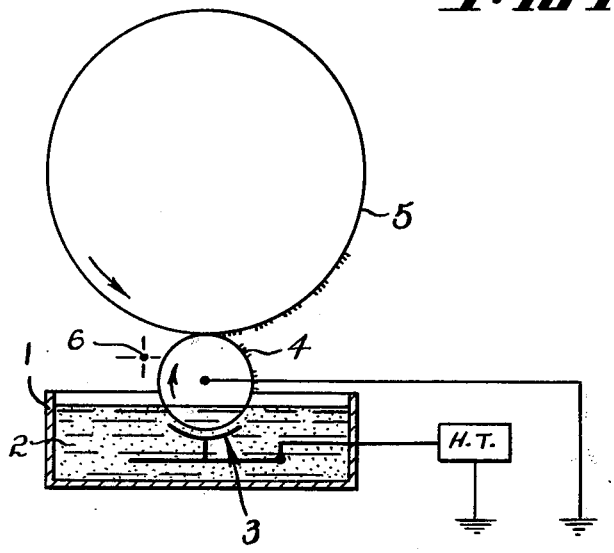
FIG. 2 shows a modification.

Referring now to FIG. 2, a corona generating electrode 6 positioned adjacent to roller 4 prior to its zone of contact with the member being developed 5 may be used if required to suppress still further the liquid dispersant contained within the toner deposit on transport roller 4. Such corona generating means may be a wire or roller or series of points as desired.

Figure 3:
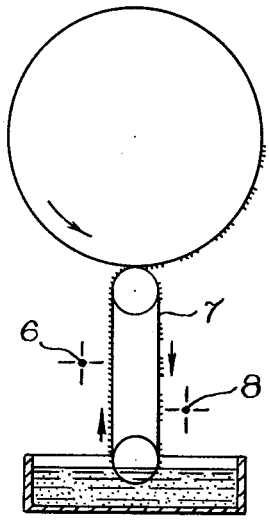
FIG. 3 shows a further modification.

In FIG. 3, the roller 4 is replaced with a moving belt 7, which belt may be of an insulating nature on which is impressed a surface charge from corona generating means 8, which replaces electrode 3. Corona generating electrode 6 to further suppress liquid carry-out can also be used in this embodiment.

Figure 4:
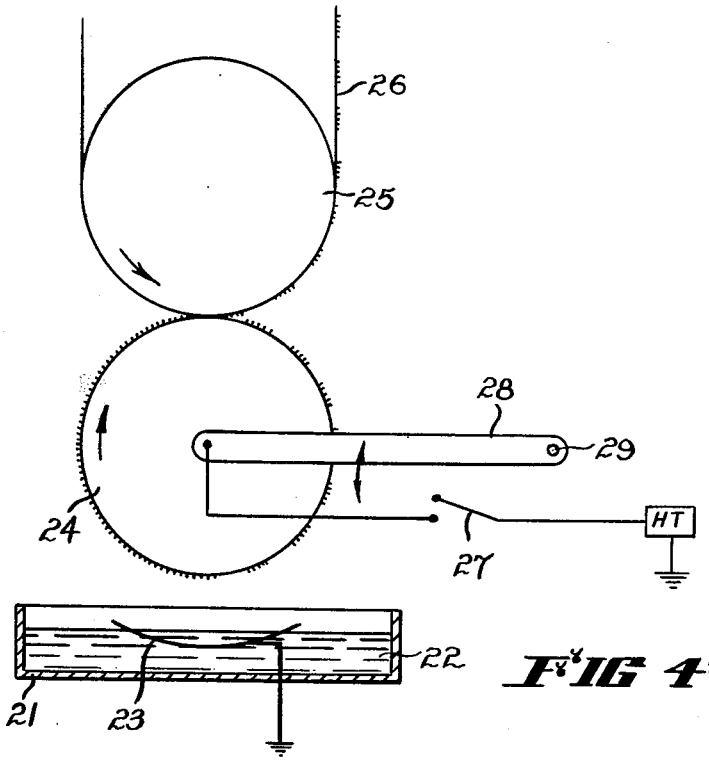
FIG. 4 shows a modification in which coating of the transport means is independent of the speed of development.

In FIG. 4, the tank or bath 21 contains the liquid dispersed toner 22 and electrode 23, in this illustration shown as grounded. The transport means 24 consists of a roller whose circumference is equivalent to the length of the recording member 26 or the image thereon to be developed. Transport means 24 is pivotally mounted on arm 28 about pivot 29, and is connected to the electrocoating power supply through switch 27, which switch is positioned to apply the coating potential to transport means 24 when transport means 24 is partially immersed in the liquid dispersed toner 22 and to switch off said coating potential when transport means 24 is raised to contact the recording member 26 to develop the image, recording member 26 being transported by roller 25, which roller is fixed in position.

As has been previously mentioned in the specification, the excess toner deposit may be removed from the transport means after development if desired, by the use of a scraper or rotating brush or other means if it is required for any purpose not to use a toner of the field limiting type. Such wiper should preferably but not essentially return the toner thus removed to the toner bath.

It will also be found advantageous to include a stirrer or other agitator within the toner bath to maintain the toner bath at a reasonably uniform concentration throughout, thus eliminating the effect of local denudation which occurs during electrodeposition. It may also be advantageous in those instances where the transport member is constructed to the same circumference as the length of the surface being developed on the image contained thereon to allow transport member to rotate to cause toner deposition thereon independently of the developing action. In this manner the thickness of the toner deposit may be controlled as desired without being dependent on the speed of the recording member in a particular machine.

This invention also has application to color development, in which instance the invention offers a means whereby the density of the developed image may be controlled to much finer limits than is possible with prior art color development processes. Further electronic or other sensing means may be provided adjacent to the transport member to provide automatic control of toner deposition within fine limits, such sensing means being used to control the power supply to the depositing electrode.

In order that the invention may be more readily understood, reference will now be made to the following examples, but it should be realised that these examples are illustrative only, and that different electrode spacings, coating speeds, depositing voltages and toner formulations may be used without departing from the spirit of the invention.

EXAMPLE 1

This example refers to the development of images on negatively charged recording members, using a grounded transport means with a positive voltage applied to the coating electrode.

| | |
|---|---|
| Liquid dispersed toner | |
| Arylamide Red, Color Index No. 12335 | 50 grms |
| Pentalyn K | 50 grms |
| Staybelite Ester 10 | 50 grms |
| Pliolite AC3 | 5 grms |
| Bitumen | 10 grms |
| Solvesso 100 | 300 grms |
| Isopar G | 100 grms |

The above components are milled in a ball mill for 16 hours, and a further 500 grms of Isopar G is added after milling. For use the toner concentrate so produced is further diluted in the proportions 15 ml of concentrate to 1 liter of Isopar G.

Pentalyn K is a pentaerythritol dimeric resin, acid No. 25, Sp. Gr. 1.09, melting range 188° – 197° C., manufactured by Hercules Powder Co.

Staybelite Ester 10 is a hydrogenated resin ester, acid No. 6 – 8, Sp. Gr. 1.0, melting range 49° – 55° C., manufactured by Hercules Powder Co.

Pliolite AC3, is a vinyl toluene acrylate, Sp. Gr. 1.03, melting range 47° – 53° C., manufactured by Goodyear.

Solvesso 100 is an aromatic hydrocarbon solvent, Sp. Gr. 0.874, flash point 110° F., boiling range 156° – 171° C., aromatic content 98.9%, manufactured by Esso Chemical.

Isopar G is an aliphatic hydrocarbon solvent, Sp. Gr. 0.750, flash point 103° F., boiling range 158° – 177° C., aromatic content 0.20%, manufactured by Humble Oil.

The liquid dispersed toner so produced was used in an apparatus in accordance with FIG. 1 to develop an electrostatic latent image on a negatively charged photoconductive recording member. The transport roller was grounded and an electrocoating potential of 500 volts positive was applied to the coating electrode. The transport roller was rotated at a peripheral speed of 5 inches per second. The electrode was 0.010 inches apart from the surface of the transport means. The image developed by contacting the recording member to the transport roller was of adequate density for office copying purposes, and relatively dry.

EXAMPLE 2

The experiment of Example 1 was repeated, with the exception that a high voltage of 4 kv positive was applied to the dispersant suppressing electrode shown in FIG. 2. The developed image was drier than in Example 1.

EXAMPLE 3

The liquid dispersed toner of Example 1 was used in conjunction with the embodiment illustrated in FIG. 3. In this instance the insulating belt was of polyvinyl butyral resin in the form of a continuous film 0.005 inch thick, and a negative potential of 8 kv was applied to the belt charging wire of FIG. 3.

EXAMPLE 4 and 5

The liquid dispersed toner of examples 1 and 2 was replaced with a copier type toner as follows:

| | |
|---|---|
| Carbon black | 300 grms |
| Reflex blue, C.I. Pigment Blue 56 | 3 grms |
| Pentalyn A | 50 grms |
| Bitumen | 50 grms |
| Pliolite AC3 | 5 grms |
| Solvesso 100 | 300 grms |
| Isopar G | 100 grms |

These components were milled together in a ball mill for 16 hours, after which a further 400 grms of Isopar G was added to form a toner concentrate. This was dispersed in Isopar G in the proportions 15 ml of concentrate to 1 liter Isopar G.

Pentalyn A is a pentaerythritol resin ester, Acid No. 6 – 16, Sp. Gr. 1.08 melting range 104°–116° C., manufactured by Hercules Powder Co.

An electrocoating voltage of 700 V positive applied to the coating electrode deposited the toner on the transport roller to a sufficient extend to develop an electrostatic latent image to a density in excess of 1.4.

EXAMPLES 6 and 7

The electrocoating voltage of examples 4 and 5 was reduced to 60 volts. The toner was deposited on the roller to a sufficient extent to develop images to a density of about 0.7, which is normal for the electrophotographic copying machines.

EXAMPLE 8

Example 6 was repeated without any applied coating voltage. An image was developed to a density of about 0.2 by the mechanical pickup of toner by the transport means as it rotated in the toner bath.

EXAMPLE 9

In this example a toner was prepared for the development of positively charged latent electrostatic images as follows:

| | |
|---|---|
| Carbon black | 50 grms |
| Pentalyn K | 75 grms |
| Solvesso 100 | 300 grms |

These components were mixed together to allow the Pentalyn K to absorb to the carbon, after which the mixture was filtered and the filtrate discarded.

The residue was placed in a ball mill and milled with 200 grms of Isopar G and 100 grms of a 25% by weight solution of natural rubber in Solvesso 100. After milling a further 400 grms of Isopar G was added.

The resulting concentrate, when dispersed in Isopar G in the proportions 15 ml of concentrate to 1 liter of Isopar G produced a relatively insensitive toner, which was sensitised to be attracted to a positively charged electrostatic latent image by adding a sensitiser to the carrier liquid. This sensitiser was prepared by dissolving 500 grms bitumen in 1 liter of Isopar H, and discarding the insoluble portion. The sensitiser was added to the diluted toner suspension in the proportions 30 ml/liter of carrier liquid.

In use a negative voltage of 110 volts was applied to the electrocoating electrode to produce a deposit of toner on the transport roller. The image developed by contacting a recording member with said coated transport means was of a density of the order of 1.0.

EXAMPLE 10

The voltage of example 9 was reduced to 60 volts, which allowed the development of an image of a density usual in office copying machines and the like.

It will be realised that in each of Examples 1 – 7 and 9 and 10 the configuration of FIG. 4 can be used. In this case the coating voltage would be applied directly to the transport roller, and would be of opposite polarity to that applied to the coating electrode in the various examples.

I claim:

1. In the method for developing electrostatic latent images comprising the steps of immersing a portion of a toner transport member in a body of insulating liquid dispersed toner particles, electrodepositing said toner particles onto at least part of said immersed portion of said toner transport member, moving said toner transport member to cause the toner deposit contained on its surface to contact the latent electrostatic image bearing surface of a recording member to develop said latent electrostatic image while said recording member and said toner transport member are moving at the same speed in relation to each other, and reimmersing said portion of said toner transport member in said body of insulating liquid dispersed toner to further electrodeposit toner particles thereon, wherein the improvement comprises maintaining said recording member in spaced relationship with respect to said body of insulating liquid dispersed toner particles, and depressing the insulating carrier liquid contained within the toner deposit on said toner transport member before said transport member contacts the latent electrostatic image bearing surface of the recording member by applying a voltage to a corona generating means positioned adjacent said toner transport member.

2. In the method for developing electrostatic latent images comprising the steps of immersing a portion of a toner transport member in a body of insulating liquid dispersed toner particles, depositing toner particles onto the surface of at least part of said immersed portion of said toner transport member, moving said toner coated transport member to cause the toner deposit contained on its surface to contact the latent electrostatic image bearing surface of a recording member to develop said latent electrostatic image while said recording member and said transport member are moving at the same speed in relation to each other, wherein the improvement comprises maintaining said recording member in spaced apart relation with respect to said body of insulating liquid dispersed toner particles, employing a continuous dielectric belt for said toner transport member and charging said continuous dielectric belt by using electrostatic generating means before immersing the continuous dielectric belt to cause said deposition of said toner particles, depressing the insulating carrier liquid contained within the toner deposit on said toner transport member before said transport member contacts the latent electrostatic image bearing surface of the recording member by applying a voltage to a corona generating means positioned adjacent said toner transport member, and recharging and reimmersing said portion of said dielectric belt in said body of insulating liquid dispersed toner to further deposit toner particles thereon.

3. In the method for developing electrostatic latent images comprising the steps of immersing a portion of a toner transport member in a body of insulating liquid dispersed toner particles, electrodepositing toner particles onto at least part of said immersed portion of said toner transport member, moving said toner transport member to cause the toner deposit contained on its surface to contact the latent electrostatic image bearing surface of a recording member to develop said latent electrostatic image while said recording member and said toner transport member are moving at the same speed in relation to each other, and reimmersing said portion of said toner transport member in said body of insulating liquid dispersed toner to further electrodeposit toner particles thereon, wherein the improvement comprises maintaining said recording member in spaced relationship with respect to said body of insulating liquid dispersed toner particles and depressing the insulating carrier liquid contained within said toner deposit on said toner transport member by applying a high voltage, having a polarity to which said toner particles are attracted, to a corona generating means positioned adjacent said toner transport member, said step of depressing the insulating carrier liquid contained within said toner deposit on said toner transport member being effected before the transport member contacts the latent electrostatic image bearing surface of the recording member.

4. In the method for developing electrostatic latent images comprising the steps of immersing a portion of a toner transport member in a body of insulating liquid dispersed toner particles, electrodepositing said toner particles onto at least part of said immersed portion of said toner transport member, moving said toner transport member to cause the toner deposit contained on its surface to contact the latent electrostatic image bearing surface of a recording member to develop said latent electrostatic image while said recording member and said toner transport member are moving at the same speed in relation to each other, and reimmersing said portion of said toner transport member in said body of insulating liquid dispersed toner to further electrodeposit toner particles thereon, wherein the improvement comprises mounting said toner transport member wherein it is lowered for immersion in said body of insulating liquid dispersed toner and removed from said latent electrostatic image bearing surface during the electrodepositing step and raised out of contact with said body of insulating liquid dispersed toner to bring the toner deposit contained on its surface to contact the latent electrostatic image bearing surface during the developing step, and applying a coating potential to said transport member when it is in its immersed position, and switching off said coating potential when said transport member is in its raised position wherein the toner deposit contained on its surface is in contact with the latent electrostatic image bearing surface.

5. In a method for developing electrostatic latent images comprising the steps of subjecting a portion of a toner transport member to a bath of insulating liquid dispersed toner particles, electrodepositing said toner particles onto a least part of said portion of said toner transport member in said bath, moving said toner transport member to cause the toner deposit contained on its surface to contact the latent electrostatic image bearing surface of a recording member to develop said latent electrostatic image while said recording member and said toner transport member are moving at the same speed in relation to each other, and again subjecting said portion of said toner transport member to said bath of insulating liquid dispersed toner to further electrodeposit toner particles thereon, wherein the improvement comprises depressing the insulating carrier liquid contained within the toner deposit on said toner transport member before said transport member contacts the latent electrostatic image bearing surface of the recording member by applying a voltage to a corona generating means positioned adjacent said toner transport member.

6. Apparatus for developing electrostatic latent images comprising a container for containing a body of insulating liquid dispersed toner, a toner transport member supported so that at least a portion thereof is periodically immersible in said body of insulating liquid dispersed toner; and toner depositing means in the body of insulating liquid dispersed toner, facing a part of said immersed portion, to form an electrostatic field within the body of insulating liquid dispersed toner between the immersed portion of the toner transport member and the toner depositing means to cause electrodeposition of toner particles onto at least a part of the immersed portion of the toner transport member, means for moving a latent electrostatic image bearing surface, latent electrostatic image bearing surface being disposed in spaced relationship with respect to said body of insulating liquid dispersed toner, means for moving said toner transport member at the same surface speed as the surface speed of said latent electrostatic image bearing surface to cause the toner deposit contained on said toner transport member to contact said latent electrostatic image bearing surface to develop said latent electrostatic image, corona generating means mounted adjacent said toner transport member in an area between said immersed portion of said transport member and where said transport member contacts said latent electrostatic image bearing surface to depress the carrier liquid contained within the toner deposit on said toner transport member, and means for reimmersing said portion of said toner transport member in said body of insulating liquid dispersed toner.

7. Apparatus for developing electrostatic latent images according to claim 6 wherein said toner depositing means in the body of insulating liquid dispersed toner comprises an electrode immersed within said body of insulating liquid disposed toner.

8. Apparatus for developing electrostatic latent images according to claim 6, further comprising means for applying a high voltage, of a polarity to which said toner particles are attracted, to said corona generating means to depress the carrier liquid contained within the toner deposit on said toner transport member.

9. Apparatus for developing electrostatic latent images comprising a container for containing a body of insulating liquid dispersed toner, a toner transport member supported so that at least a portion thereof is periodically immersible in said body of insulating liquid dispersed toner, said toner transport member being a continuous dielectric belt, means for electrostatically charging said belt prior to its immersion in said body of insulating liquid dispersed toner to cause said dielectric belt to attract and hold a deposit of toner particles on its charged surface means for moving a latent electrostatic image bearing surface, said latent electrostatic image bearing surface being disposed in spaced relationship with respect to said body of insulating liquid dispersed toner, means for moving said toner transport member at the same surface speed as the surface speed of said latent electrostatic image bearing surface to cause the toner deposit contained on said toner transport member to contact said latent electrostatic image bearing surface to develop said latent electrostatic image, corona generating means mounted adjacent said toner transport member in an area between said immersed portion of said transport member and where said transport member contacts said latent electrostatic image bearing surface to depress the carrier liquid contained within the toner deposit on said toner transport member, and means for reimmersing said portion of said toner transport member in said body of insulating liquid dispersed toner.

10. Apparatus for developing electrostatic latent images comprising a container for containing a body of insulating liquid dispersed toner, a continuous dielectric belt, means for immersing a portion of said dielectric belt in said body of insulating liquid dispersed toner, a first charging means for electrostatically charging said belt prior to its immersion in said body of insulating liquid dispersed toner to cause said dielectric belt to attract and hold a deposit of toner particles on its charged surface, means for moving a latent electrostatic image bearing surface, said latent electrostatic image bearing surface being disposed in spaced relationship with respect to said body of insulating liquid dispersed toner, means for moving said continuous dielectric belt at the same surface speed as the surface speed of said latent electrostatic image bearing surface to cause the toner deposit contained on said dielectric belt to contact said latent electrostatic image bearing surface to develop said latent electrostatic image, a second charging means mounted adjacent said electrostatic belt in an area between said immersed portion of said dielectric belt and wherein said dielectric belt contacts said latent electrostatic image bearing surface, means for applying a high voltage, of the same polarity as that to which said toner particles are attracted, to said second charging means to depress the carrier liquid contained within the toner deposit on said dielectric belt, and means for reimmersing said portion of said dielectric belt in said body of insulating liquid dispersed toner.

11. Apparatus for developing electrostatic latent images comprising a container for containing a body of insulating liquid dispersed toner, a latent electrostatic image bearing surface, a toner transport member, means for reciprocating said toner transport member between a first position wherein said transport member is removed from said latent electrostatic image bearing surface and at least a portion thereof is immersed in said body of insulating liquid dispersed toner and a second position wherein said toner transport member is in its transfer position with respect to said latent electrostatic image bearing surface and removed from said body of insulating liquid dispersed toner; means for applying a coating potential to said transport member when said transport member is in its first position, switching means to switch off said coating potential application when said transport member is in its second position; and toner depositing means in the body of insulating liquid dispersed toner, facing a part of said immersed portion, to form an electrostatic field within the body of insulating liquid dispersed toner between the immersed portion of the toner transport member and the toner depositing means to cause electrodeposition of toner particles onto at least a part of the immersed portion of the toner transport member, means for moving said latent electrostatic image bearing surface.

12. Apparatus for developing electrostatic latent images according to claim 11, further comprising means for moving said toner transport member, when in its second position, at the same surface speed as the surface speed of said latent electrostatic image bearing surface to cause the toner deposit contained on said toner transport member to contact said latent electrostatic image bearing surface to develop said latent electrostatic image, and means for reimmersing said portion of said toner transport member in said body of insulating liquid dispersed toner, and wherein said switching means to switch off said coating potential application when said transport member is in its second position is actuated by the movement of said transport member.

* * * * *

UNITED STATES PATENT OFFICE

CERTIFICATE OF CORRECTION

Patent No. 4,021,586 Dated May 3, 1977

Inventor(s) JOSEF MATKAN

It is certified that error appears in the above-identified patent and that said Letters Patent are hereby corrected as shown below:

Column 8, Claim 5, line 38, after "comprises" insert --maintaining said recording member in spaced relationship with respect to said body of insulating liquid dispersed toner particles and--.

Column 8, Claim 6, line 59, after "surface," insert --said--.

Signed and Sealed this ninth Day of August 1977

[SEAL]

Attest:

RUTH C. MASON
Attesting Officer

C. MARSHALL DANN
Commissioner of Patents and Trademarks